US007743560B2

(12) United States Patent
Box

(10) Patent No.: US 7,743,560 B2
(45) Date of Patent: Jun. 29, 2010

(54) DOOR SEALING SYSTEM

(76) Inventor: Neil K. Box, 205 Glade Bridge Dr., Dickinson, TX (US) 77539

( * ) Notice: Subject to any disclaimer, the term of this patent is extended or adjusted under 35 U.S.C. 154(b) by 1055 days.

(21) Appl. No.: 11/413,805

(22) Filed: Apr. 28, 2006

(65) Prior Publication Data

US 2007/0251147 A1 Nov. 1, 2007

(51) Int. Cl.
*E04H 15/20* (2006.01)

(52) U.S. Cl. ..... 52/2.11; 52/1; 49/319

(58) Field of Classification Search ..... 49/477.1, 49/316, 319; 52/1, 2.11–2.26; 292/137, 292/163, 146, 150
See application file for complete search history.

(56) References Cited

U.S. PATENT DOCUMENTS

| | | | | | |
|---|---|---|---|---|---|
| 2,530,160 | A | * | 11/1950 | Finley | 49/477.1 |
| 3,074,520 | A | * | 1/1963 | Grubelich | 403/5 |
| 3,224,150 | A | * | 12/1965 | Burtoft et al. | 52/2.14 |
| 4,006,392 | A | * | 2/1977 | Catlett et al. | 318/266 |
| 4,676,025 | A | * | 6/1987 | Mattscheck et al. | 49/477.1 |
| D293,935 | S | * | 1/1988 | Allen, Jr. | D25/164 |
| 4,773,183 | A | * | 9/1988 | Okushima et al. | 49/28 |
| 5,150,543 | A | | 9/1992 | Wessiepe et al. | |
| 5,172,094 | A | * | 12/1992 | Stadler | 340/426.11 |
| 5,220,696 | A | * | 6/1993 | Dannenberg et al. | 4/556 |
| 5,351,345 | A | * | 10/1994 | Sills et al. | 4/555 |
| 5,771,635 | A | * | 6/1998 | Skinner | 49/25 |
| 5,851,248 | A | * | 12/1998 | Wilson et al. | 55/357 |
| 5,979,828 | A | * | 11/1999 | Gruensfelder et al. | 244/129.1 |
| 6,125,591 | A | * | 10/2000 | Schmidhuber et al. | 49/477.1 |
| 6,152,208 | A | * | 11/2000 | Kalempa et al. | 160/273.1 |
| 6,192,633 | B1 | * | 2/2001 | Hilbert | 52/2.18 |
| 6,195,941 | B1 | * | 3/2001 | Burow et al. | 49/477.1 |
| 6,259,352 | B1 | * | 7/2001 | Yulkowski et al. | 340/5.7 |
| 6,485,029 | B1 | | 11/2002 | Moody et al. | |
| 6,591,662 | B1 | * | 7/2003 | Grimard et al. | 73/46 |
| 6,922,945 | B2 | * | 8/2005 | Dron | 49/477.1 |
| 7,118,472 | B2 | * | 10/2006 | Kennedy et al. | 454/169 |
| 7,152,375 | B1 | * | 12/2006 | Mastro et al. | 49/507 |
| 7,178,810 | B1 | * | 2/2007 | Kuhary | 277/646 |
| 7,357,710 | B2 | * | 4/2008 | Dube | 454/334 |
| 7,469,942 | B2 | * | 12/2008 | Whitaker et al. | 292/92 |
| 7,487,616 | B2 | * | 2/2009 | Deaver | 49/498.1 |
| 2005/0044908 | A1 | * | 3/2005 | Min | 70/276 |
| 2007/0251147 | A1 | * | 11/2007 | Box | 49/21 |

* cited by examiner

*Primary Examiner*—Richard E Chilcot, Jr.
*Assistant Examiner*—James Ference
(74) *Attorney, Agent, or Firm*—Dale J. Ream

(57) ABSTRACT

A door sealing system includes a frame and a pneumatic liner positioned along an inner perimeter of the frame. The liner includes a hollow interior for adjusting it between extended and retracted configurations. A pump is included for selectively inflating the liner and a valve which can be deactivated to deflate the liner. When inflated, the liner fills the gap between the door and the frame and when deflated, allows the door to be opened easily. A sensor is positioned with a cavity in the frame for detecting placement of a latch indicative of the door being opened or closed. A processor then appropriately actuates the pump or deactivates the valve. Accordingly, the seal is inflated when the door is closed and is deflated when the door is being opened.

4 Claims, 7 Drawing Sheets

DOOR SEALING SYSTEM

BACKGROUND OF THE INVENTION

This invention relates generally to door seals and, more particularly, to a door seal system having a pneumatic seal that automatically inflates and deflates when a door is closed or opened, respectively.

There must be a gap between a door and its doorframe in order for the door to open and close efficiently. A door seal, however, is usually installed upon an inner surface of the door frame for sealing out air, dust, sound, light, insects, etc. Having a good door seal contributes to energy efficiency and savings on heating and cooling costs.

Various types of door seals have been proposed in the art. Although assumably effective, traditional door seals are not able to completely conform to the gap between a door and a frame, especially where the gaps are irregular or change over time. Further, having very thick door seals to completely fill all gaps makes opening and closing doors too difficult.

Therefore, it would be desirable to have a door sealing system that includes a pneumatic liner for completely filling the gap between the door and the frame. Further, it would be desirable to have a door sealing system that automatically inflates when a door is closed and automatically deflates when a door is opened.

SUMMARY OF THE INVENTION

Accordingly, a door sealing system according to the present invention includes a door frame and a pneumatic liner disposed along an inner perimeter of the frame for preventing air leakage between the frame and the door. The door sealing system includes a construction that may be adjusted between extended and retracted configurations. The system further includes a pump in communication with the liner for selectively filling the liner with air or other gaseous substance and includes a release valve for selectively the air therefrom. When the liner is expanded, it conforms to the space between the frame and door, even if the space is irregular. When the air is exhausted, the door is able to open easily.

The door sealing system includes a sensor and a processor for controlling when the pump and valve are actuated to either inflate or deflate the pneumatic liner. In operation, the sensor senses when a latch is received into a cavity indicative of the door being closed. The processor, then, actuates the pump to inflate the liner. Conversely, when the latch is detected outside the cavity indicating the door is being opened, the valve is deactivated to allow the liner to be deflated.

Therefore, a general object of the invention is to provide a door sealing system having a pneumatic liner mounted to an inner perimeter of a door frame.

Another object of this invention is to provide a door sealing system, as aforesaid, in which the pneumatic liner may be selectively inflated and deflated.

Still another object of this invention is to provide a door sealing system, as aforesaid, which includes a sensor for detecting if the door is opened or closed.

Yet another object of this invention is to provide a door sealing system, as aforesaid, which actuates a pump to inflate the liner when the door is closed and deactivates a valve to deflate the liner when the door is opened.

A further object of this invention is to provide a door sealing system, as aforesaid, having a proximity sensor capable of detecting a person approaching the door and deflating the liner accordingly.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
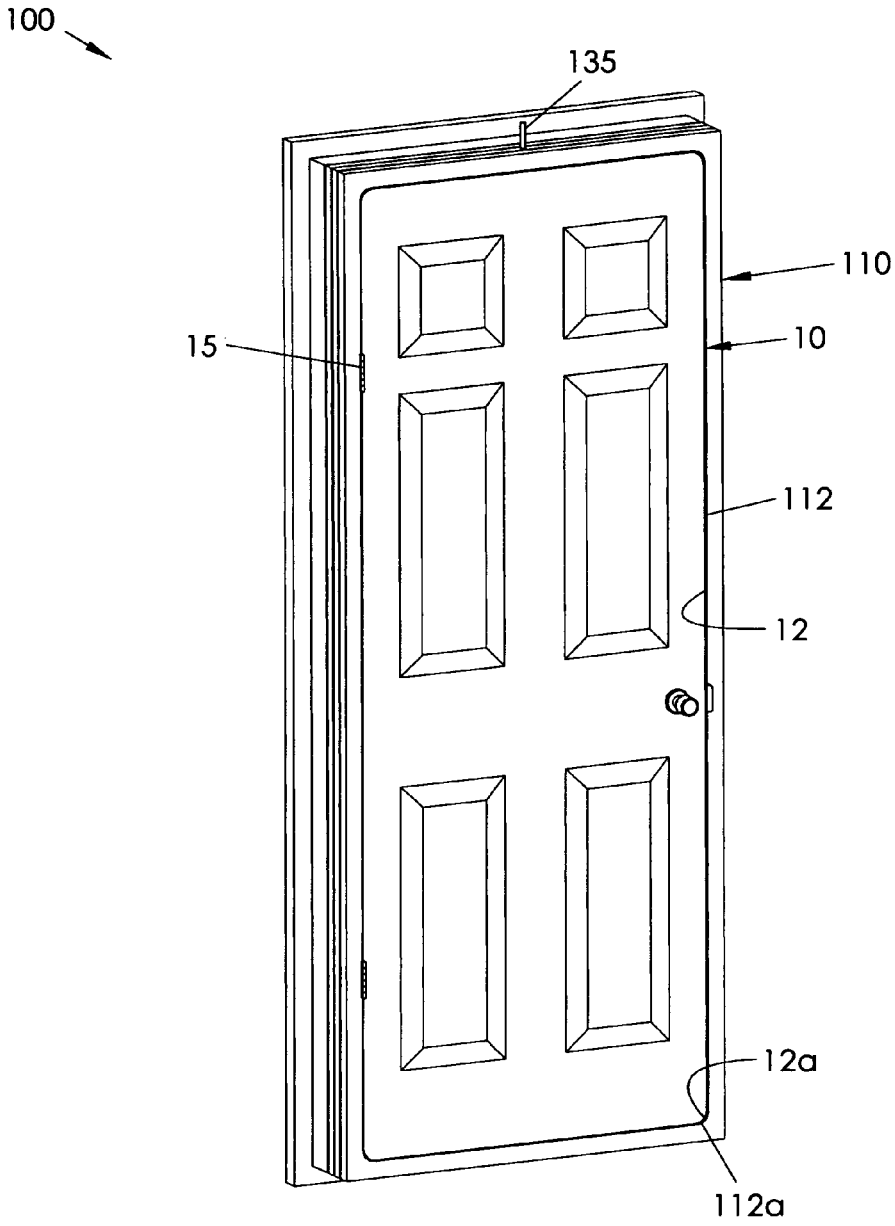
FIG. 1 is a perspective view of a door sealing system according to the present invention.
Figure 2B:
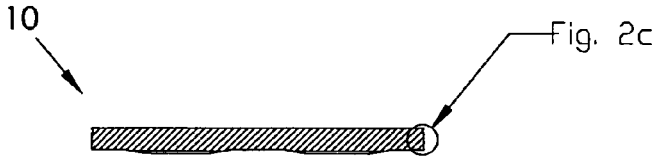
FIG. 2*b* is a top view of the door as in FIG. 2*a;*
Figure 2A:
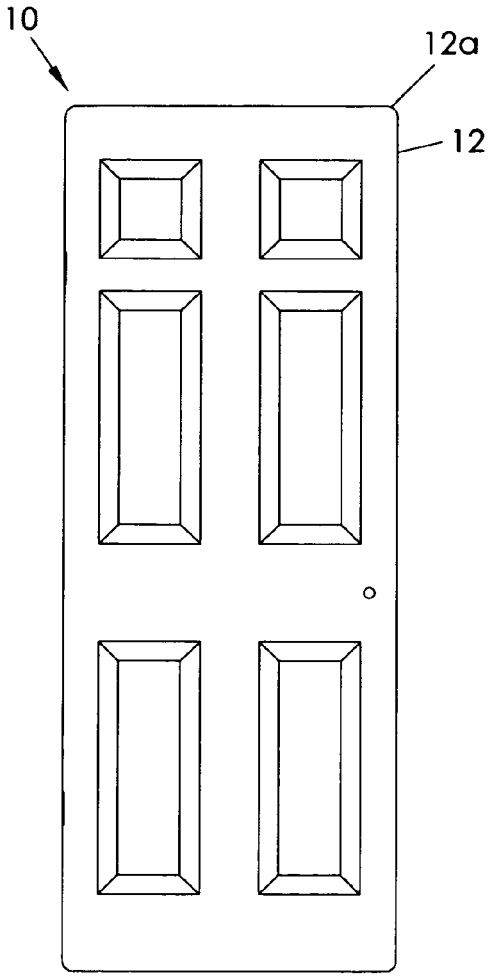
FIG. 2*a* is a front view of a door of the system as in FIG. 1.
Figure 2C:
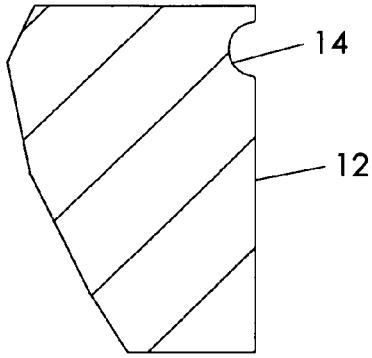
FIG. 2*c* is an isolated portion on an enlarged scale taken from FIG. 2*b;*

A door sealing system 100 according to the present invention will now be described in detail with reference to FIGS. 1 through 5 of the accompanying drawings. More particularly, a door sealing system 100 according to the current invention is for use with a door 10 and includes a frame 110 having an inner perimeter 112 sized to receive the door 10.

Figure 3B:
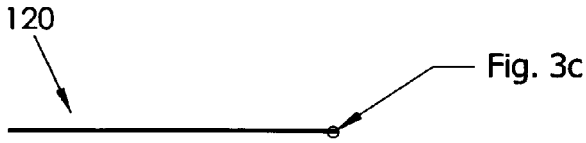
FIG. 3*b* is a sectional view taken along line 3*b*-3*b* of FIG. 3*a;*
Figure 3A:
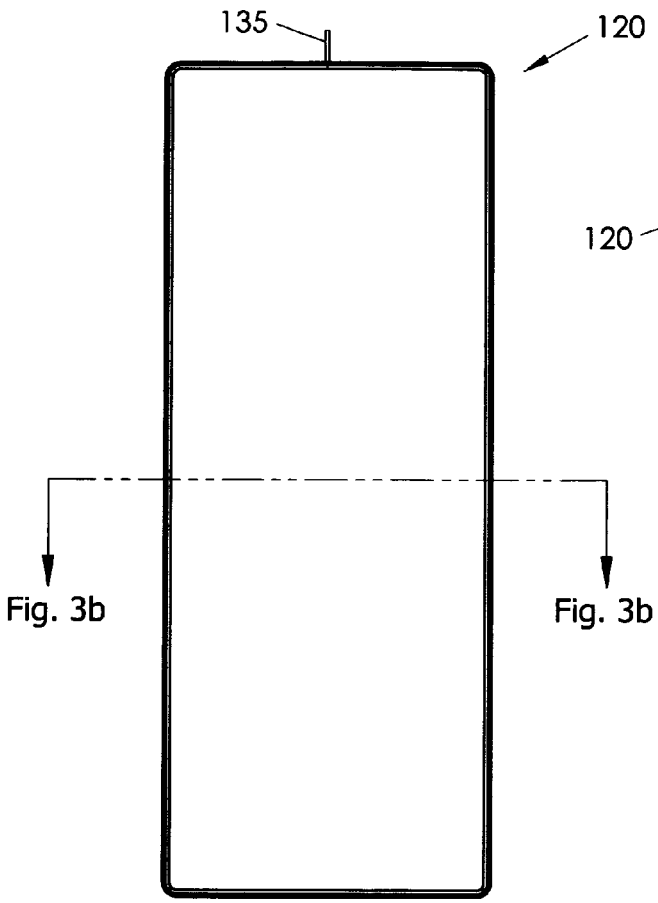
FIG. 3*a* is a front view of a pneumatic liner removed from the system as in FIG. 1.
Figure 3C:
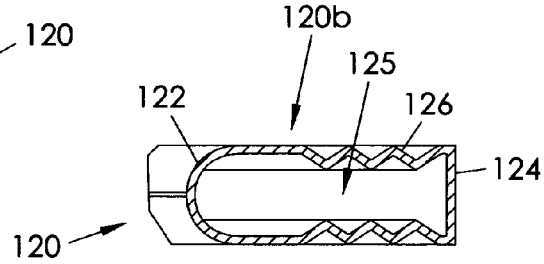
FIG. 3*c* is an isolated view on an enlarged scale taken from FIG. 3*b* with the liner in an extended configuration.
Figure 3D:
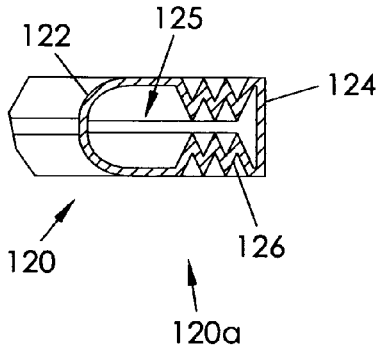
FIG. 3*d* is an isolated view on an enlarged scale taken from FIG. 3*b* with the liner in an retracted configuration.

A pneumatic liner 120 is positioned along at least a portion of the frame inner perimeter 112 to selectively prevent leakage (e.g., passage of air) between the frame 110 and the door 10. In various embodiments, the pneumatic liner 120 may be positioned along the entire frame inner perimeter 112 to encircle the door 10. As shown in FIGS. 3*c* and 3*d*, the pneumatic liner 120 may have a hollow interior region 125 and be selectively adjustable between a retracted configuration 120*a* (FIG. 3*d*) and an extended configuration 120*b* (FIG. 3*c*). The liner 120 has an exterior mating surface 122 for contact with the door 10 and an exterior attachment surface 124 opposite the mating surface 122. The exterior attachment surface 124 may be attached to the frame inner perimeter 112. The pneumatic liner 120 may have parallel accordion pleats 126 (FIGS. 3*c* and 3*d*) between the exterior attachment surface 124 and the exterior mating surface 122 to allow the pneumatic liner 120 to be selectively adjusted between the extended and retracted configurations 120*b*, 120*a*. It is currently preferred that the pneumatic liner 120 be biased to the retracted configuration 120*a*, as discussed below, though this need not be the case.

Figure 4A:
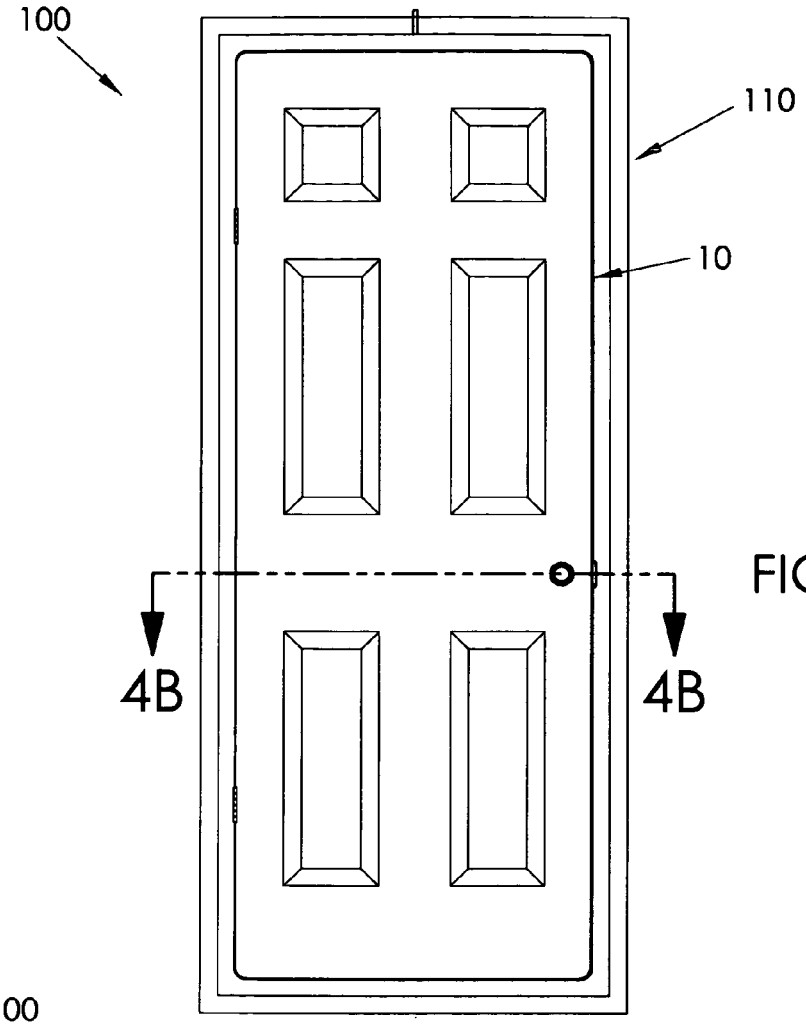
FIG. 4*a* is a front view of the system as in FIG. 1.
Figure 4B:
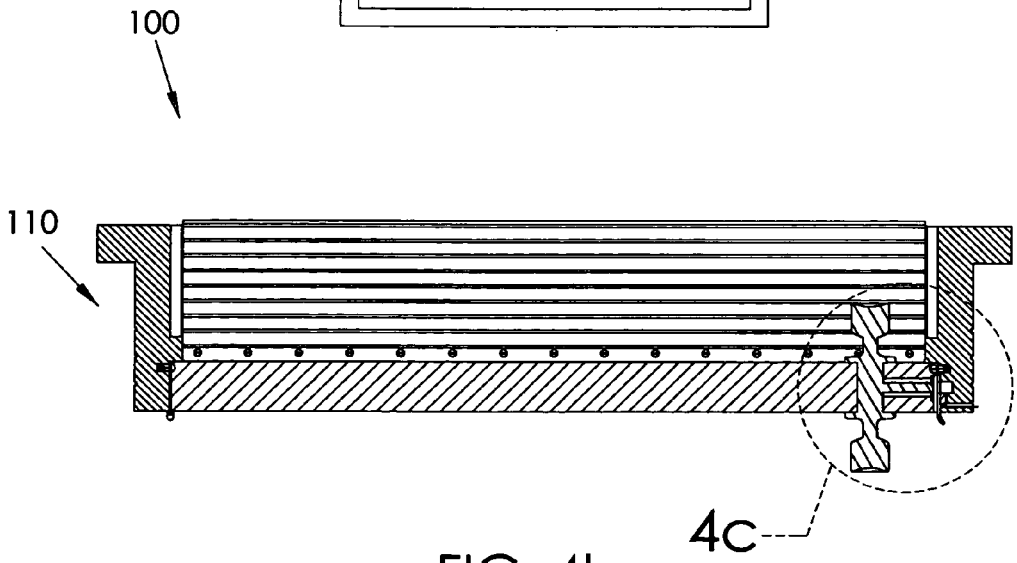
FIG. 4*b* is a sectional view taken along line 4*b*-4*b* of FIG. 4*a;*
Figure 4C:
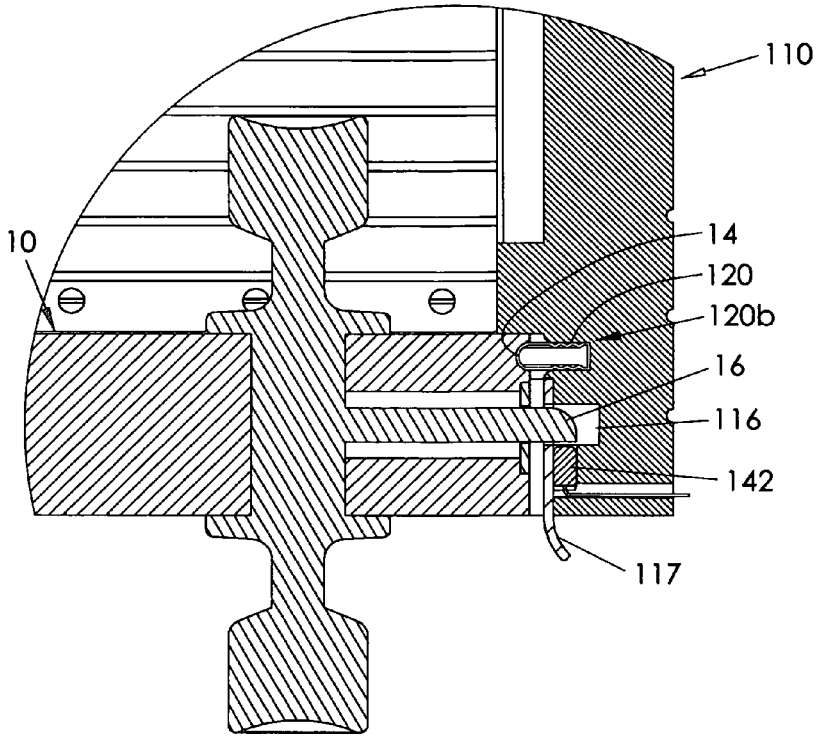
FIG. 4*c* is an isolated view on an enlarged scale taken from FIG. 4*b* showing the door latch in the frame cavity.

As shown in FIG. 4*c*, the door 10 may have an exterior perimeter 12 with a configuration complementary to a configuration of the pneumatic liner exterior mating surface 122 when the pneumatic liner 120 is at the extended configuration 120*b*. More particularly, a groove 14 may extend along the entire door exterior perimeter 12 (FIG. 2*c*), and the groove 14 may be complementary to the pneumatic liner exterior mating surface 122 when the pneumatic liner is at the extended configuration 120*b*. The frame inner perimeter 112 and the door exterior perimeter 12 may both have rounded corners 112*a*, 12*a* (FIG. 1) so that the pneumatic liner 120 does not have to meet the door 10 or the frame 110 at a right angle, and the door 10 may be hingedly coupled to the frame 110 (e.g., by hinge 15).

Means for selectively adjusting the pneumatic liner 120 between the retracted and extended configurations 120*a*, 120*b* are included. More particularly, a pump 132 (e.g., an air pump or compressor) may be in communication with the pneumatic liner hollow interior region 125 for selectively introducing a gaseous substance (e.g., air) into the hollow interior region 125 to adjust the pneumatic liner 120 to the extended configuration 120*b*. It is understood that a portable, refillable air tank may also be used in place of or in cooperation with an air compressor. A valve 134 (FIG. 5) may be in communication with the pneumatic liner hollow interior region 125 for selectively allowing the gaseous substance to exit the hollow interior region 125 to adjust the pneumatic liner 120 to the retracted configuration 120*a*. The pump 132 may be incorporated in the frame 110, or the pump 132 may be remote from the pneumatic liner 120 and connected to the pneumatic liner 120 by tubing 135 (FIGS. 3*a* and 4*a*). It is currently preferred that the valve 134 be biased to allow the gaseous substance to exit the hollow interior region 125 when the valve 134 is not actuated, as discussed below, though this need not be the case.

Means for actuating the pump 132 and the valve 134 are included. More particularly, according to one embodiment, the door 10 includes a latch 16 (FIGS. 4*c* and 4*d*) that selectively extends outwardly, and the frame defines a cavity 116 positioned and sized to receive at least a portion of the latch 16 when the door 10 is positioned in the frame 110 and the latch 16 is extended. A sensor 142 (FIG. 5) is included for determining whether the latch 16 is received in the cavity 116, and a processor 144 is in data communication with the sensor 142, the pump 132, and the valve 134. The processor 144 may only actuate the pump 132 when the latch 16 enters the cavity 116 and may only actuate the valve 134 as long as the latch 16 remains in the cavity 116; this collectively forces the pneumatic liner 120 to the extended configuration 120*b* when the latch 16 is in the cavity 116. According to another embodiment, a plate 117 is coupled to the frame 110 adjacent the cavity 116, and the sensor 142 is included for determining whether the latch 16 is adjacent the plate 117. In this embodiment, the processor 144 may only actuate the pump 132 when the latch 16 becomes adjacent the plate 117 and may only actuate the valve 134 as long as the latch remains adjacent the plate 117; this collectively forces the pneumatic liner 120 to the extended configuration 120*b* when the latch 16 is adjacent the plate 117.

Figure 5:
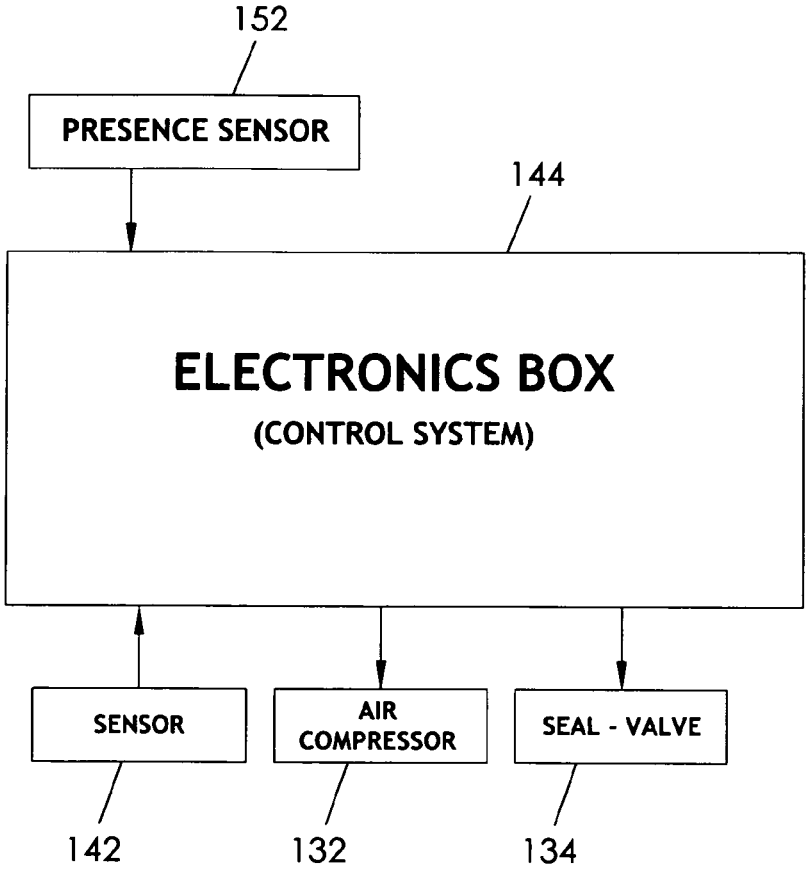
FIG. 5 is a block diagram showing the electronic components of the present invention.
Figure 6A:
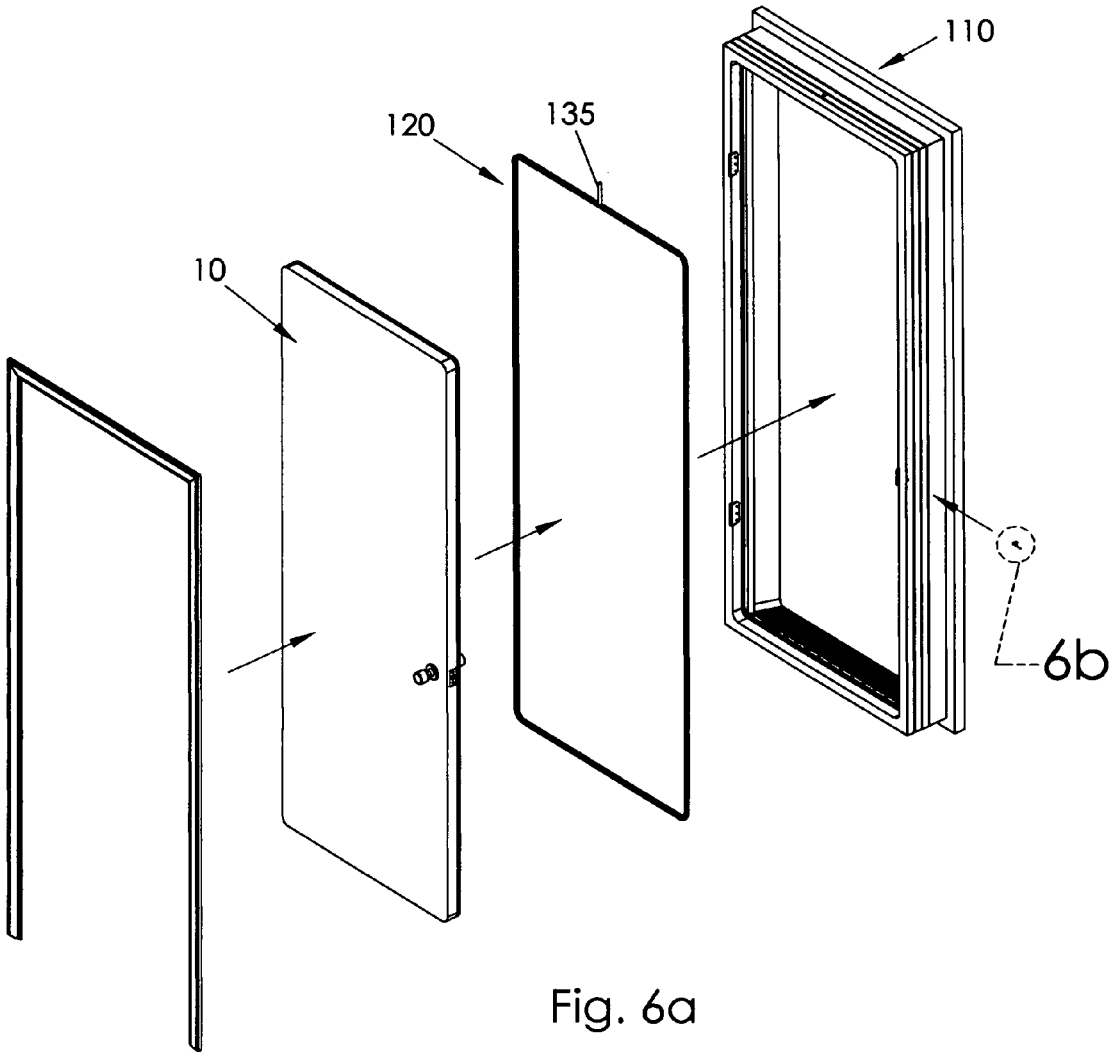
FIG. 6 is an exploded view of the door sealing system according to the present invention.
Figure 6B:
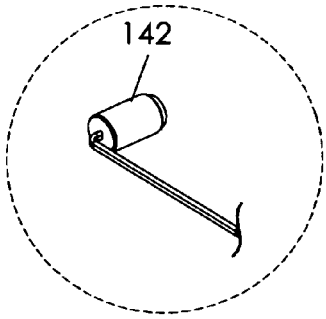

As shown in FIG. 5, at least one presence sensor 152 may be included to determine when someone is approaching the door 10. As used herein, "presence sensor" refers to a sensor capable of detecting a person's presence (e.g., a proximity sensor or a motion sensor). The processor 144 may include programming for deactivating the valve 134 when the presence sensor 152 determines someone is approaching the door 10.

Figure 4D:
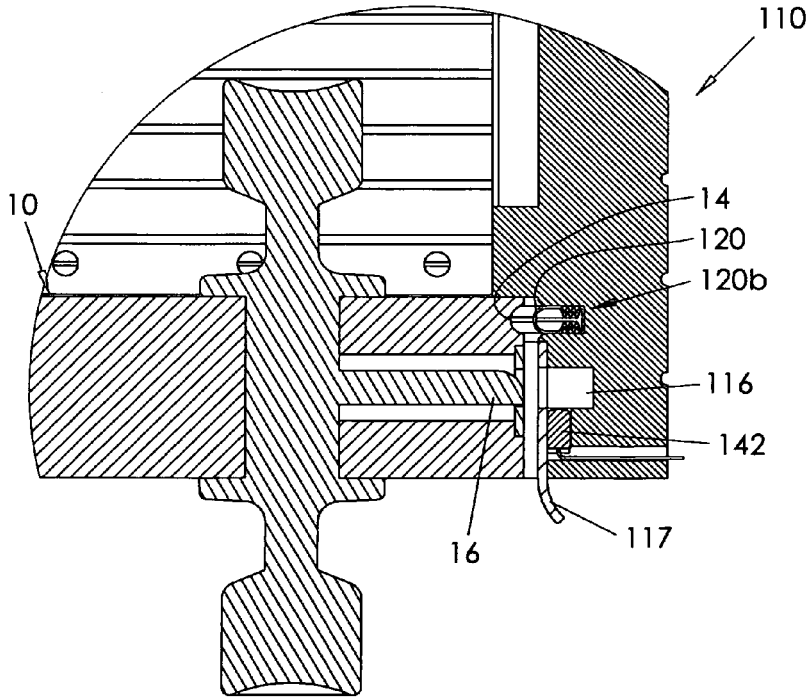
FIG. 4*d* is an isolated view on an enlarged scale taken from FIG. 4*b* showing the door latch retracted from the frame cavity.

In use, the door 10 is coupled to the frame 110 (i.e., by hinge 15) so that the door 10 may selectively open and close. The sensor 142 may detect when the door 10 is received in the frame 110, such as by detecting when the door latch 16 enters the frame cavity 116 or when the door latch 16 is adjacent the plate 117. When the sensor 142 does detect that the door 10 is newly received in the frame 110, the processor 144 may actuate the pump 132 and valve 134 as described above. The pump 132 may then pump the gaseous substance into the pneumatic liner hollow interior region 125, and the valve 134 may keep the gaseous substance from exiting the liner 120. As a result, the parallel accordion pleats 126 may be forced to extend, causing the pneumatic liner 120 to adjust to the extended configuration 120*b* (FIG. 4*c*). Importantly, the pump 132 is deactivated (at the latest) when the pneumatic liner 120 reaches the extended configuration 120*b*. When the liner 120 is at the extended configuration 120*b*, the exterior mating surface 122 of the liner 120 may mate with the door groove 14 to effectively seal the area between the door 10 and the frame 110. It may be difficult to open the door 10 when the pneumatic liner 120 is at the extended configuration 120*b*. If the presence sensor 152 is included, the processor 144 may deactivate the valve 134 when the presence sensor 152 determines someone is approaching the door 10. If the presence sensor 152 is not included, or if it does not appropriately detect someone's presence, the processor 144 may deactivate the valve 134 when the sensor 142 determines that the door latch 16 is not in the frame cavity 116 or that the door latch 16 is not adjacent the plate 117 (FIG. 4*d*). When the valve 134 is deactivated, the gaseous substance may be allowed to escape the pneumatic liner interior region 125, causing the pneumatic liner 120 to return to the retracted configuration 120*a*. When the pneumatic liner 120 is at the retracted configuration 120*a*, the door may be easily opened.

In another embodiment, a carbon monoxide sensor (not shown) may be integrated into the frame 110 for providing an alarm when unacceptable levels of carbon monoxide are detected. The carbon monoxide sensor may be powered and actuated independently or may be wired directly into a larger security or ambient air detection system.

It is understood that while certain forms of this invention have been illustrated and described, it is not limited thereto except insofar as such limitations are included in the following claims and allowable functional equivalents thereof.

What is claimed is as follows:

1. A door sealing system, comprising:

a frame having an inner perimeter;

a door hingedly coupled to said frame;

said frame comprising a pneumatic liner positioned along an entirety of said frame inner perimeter to selectively prevent leakage between said frame and said door, said pneumatic liner having a hollow interior region and being selectively adjustable between extended and retracted configurations;

a pump in fluid communication with said pneumatic liner hollow interior region for selectively introducing a gaseous substance into said hollow interior region to adjust said pneumatic liner to said extended configuration;

a valve in fluid communication with said pneumatic liner hollow interior region for selectively allowing the gaseous substance to exit said hollow interior region to adjust said pneumatic liner to said retracted configuration;

means for actuating said pump and said valve, wherein:

said pneumatic liner has an exterior mating surface;

said door has an exterior perimeter having a configuration complementary to a configuration of said pneumatic liner exterior mating surface when said pneumatic liner is at said extended configuration;

said pneumatic liner has an exterior attachment surface opposite said exterior mating surface, said exterior attachment surface being attached to said frame inner perimeter;

said pneumatic liner has parallel accordion pleats between said exterior attachment surface and said exterior mating surface to allow said pneumatic liner to be selectively adjusted between said extended and retracted configurations, said pneumatic liner being biased to said retracted configuration;

a groove extends along the entire said door exterior perimeter;

said groove is complementary to said pneumatic liner exterior mating surface when said pneumatic liner is at said extended configuration;

said pneumatic liner extends into said groove when in the extended configuration;

a latch selectively extends from said door;

said frame defines a cavity positioned and sized to receive at least a portion of said latch when said door is positioned in said frame and said latch is extended from said door;

a plate is coupled to said frame adjacent said cavity;

said valve is biased to allow the gaseous substance to exit said hollow interior region when said valve is not actuated;

said means for actuating said pump and said valve includes:

a sensor mounted directly adjacent between an exterior surface of said frame and said latch for determining whether said latch is adjacent said plate; and a processor in data communication with said sensor, said pump, and said valve to only actuate said pump when said latch becomes adjacent said plate and to only actuate said valve as long as said latch remains adjacent said plate for collectively forcing said pneumatic liner to said extended configuration when said latch is adjacent said plate;

at least one presence sensor to determine when someone is approaching said door; and wherein said processor includes programming for deactivating said valve when said at least one presence sensor determines someone is approaching said door.

2. The system of claim 1, wherein:

said frame inner perimeter has rounded corners; and said door exterior perimeter has rounded corners.

3. The system of claim 1, wherein said pump is remote from said pneumatic liner and tubing connects said pump and said pneumatic liner.

4. The system of claim 1, wherein said gaseous substance is air.

* * * * *